United States Patent [19]

Philp

[11] 4,298,853

[45] Nov. 3, 1981

[54] COMPACT HIGH VOLTAGE SHUNT REACTOR

[75] Inventor: Sanborn F. Philp, Pittsfield, Mass.

[73] Assignee: General Electric Company, Schenectady, N.Y.

[21] Appl. No.: 134,429

[22] Filed: Mar. 27, 1980

[51] Int. Cl.[3] ..... H01B 27/24

[52] U.S. Cl. ..... 336/83; 336/212; 336/219; 336/234

[58] Field of Search ..... 336/83, 84 R, 84 M, 336/219, 212, 234, 90, 94, 223, 69, 70

[56] References Cited

U.S. PATENT DOCUMENTS 2,696,593 12/1954 Dole ..... 336/83

3,014,189 12/1961 MacKinnon et al. ..... 336/83 X

OTHER PUBLICATIONS

Christoffel, Martin, "The Design and Testing of EHV Shunt Reactors", IEEE Transactions on Power Apparatus and Systems, vol. PAS-86, No. 6, Jun. 1967, pp. 684–692.

Edlinger, A., "Transformers and Shunt Reactors for 750 kV", The Brown Boveri Review, vol. 51, No. ½, Jan./Feb., 1964, pp. 56–58.

Meyerhaus, A., "A New Design for Shunt Reactors of High Rating", The Brown Boveri Review, vol. 45, No. 9, Sep., 1958, pp. 407–410.

Dixon, G. F. and Price, J. B. S., "Multi-Core Single--Phase Generator Transformers", Electrical Review, Oct. 4, 1968, pp. 488–491.

Dietrich, W., and Weigel, G., "380-kV Power Transformers for the Netherlands", Siemens Review, vol. 36, No. 8, 1969, pp. 296–301.

*Primary Examiner*—Thomas J. Kozma

*Attorney, Agent, or Firm*—William H. Steinberg; James C. Davis, Jr.; Paul R. Webb, II

[57] ABSTRACT

A high voltage shunt reactor includes a cylindrical magnetic shell of radially extending laminated layers of magnetic material, and a coil wound within the shell having a large reactance volume within the coil. The reactor uses a portion of the nonmagnetic, reactance volume within the coil for high voltage insulation. This construction substantially increases the energy storage volume within the reactor, so that a high energy storage level may be achieved.

10 Claims, 3 Drawing Figures

COMPACT HIGH VOLTAGE SHUNT REACTOR

BACKGROUND OF THE INVENTION

The instant invention relates to high voltage shunt reactors for high voltage electrical power transmission lines, and more particularly, to a coreless reactor contained within a magnetic shell for use on high voltage power transmission lines.

High voltage shunt reactors are employed on electrical power transmission lines, normally operating in the 138 kilovolt to 1300 kilovolt range, where they are usually connected from line to ground. These devices are an essential element in such power transmission systems in the control of line voltage, and of line impedance and, therefore, also power flow. Reactors are installed at terminal substations as well as at strategic points along the transmission line, and are designed to provide a constant reactance, or a reactance which changes with voltage, or in some cases, a reactance which can be changed by a suitable switching operation.

Conventional, high voltage reactors closely resemble conventional power transformers in their physical construction. In the conventional design, the reactance characteristics are achieved by providing a number of thin "air gaps" in the main leg of the magnetic core, which is surrounded by a coil. These are not really air gaps but are filled with some non-magnetic material, chosen to meet the mechanical and electrical requirements of the reactor design. The reactance gaps are often filled with pieces of stone, cut and ground to the desired shape or may be filled with other commonly-used insulation material, for example, mineral oil combined with cellulosic material such as craft paper, paper composites and wood. The thermal and mechanical stresses present in a high voltage reactor and the limitations of these conventional materials have presented a limitation on the design of high voltage reactors. Another major practical limitation is in the design of the pole faces of the core where they meet the reactance gaps. Large losses have been associated with this region in the conventional machines, due to stray flux entering the adjacent coil parts and heating them.

SUMMARY OF THE INVENTION

An object of the instant invention is to provide a smaller, lighter weight high voltage shunt reactor having lower power losses than the conventional machine. A more specific object is to provide a coreless reactor having the reactor coil contained within a magnetic shell and defining a large energy storage volume radially within said coil, in which the high voltage lead and portions of the coil which are at high voltage are insulated in a simple and effective manner. A still more specific object is to provide a high voltage reactor having an outer magnetic shield of radially extending laminations surrounding the coil.

Accordingly, the instant invention discloses a high voltage shunt reactor in which a shell of magnetic material is disposed within a housing and a coil is wound about the interior of the housing providing a nonmagnetic core serving as a reactance volume, and within which a high voltage lead is disposed a make electrical connection with the coil. The magnetic shell is made up of a plurality of circumferentially-adjacent, radially extending laminations of magnetic material. In a particularly preferred embodiment, the coil comprises a plurality of layers of sheet conductor wound concentrically about the nonmagnetic core, and the magnetic shell includes end plates made up of a plurality of laminations of radially-extending sheets of magnetic material.

BRIEF DESCRIPTION OF THE DRAWINGS

The features of the invention believed to be novel and unobvious over the prior art art set forth with particularity in the appended claims. The invention itself, however, as to organization, method of operation and advantages thereof, may best be understood by reference to the following description taken in conjunction with the accompanying drawings in which:

DESCRIPTION OF THE PREFERRED EMBODIMENTS

Figure 1:
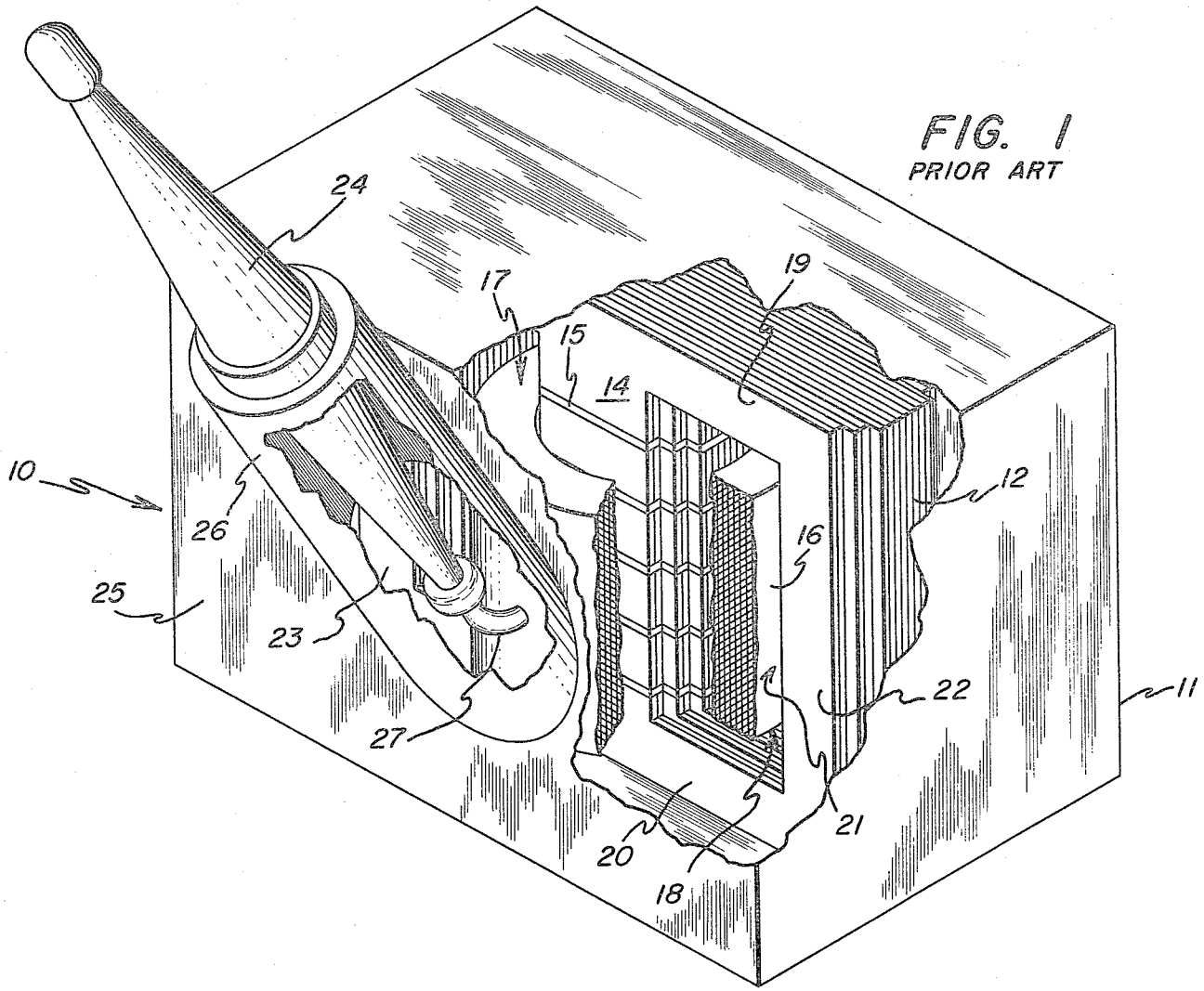
FIG. 1 PRIOR ART
FIG. 1 is a schematic pictorial view with portions broken away of a conventional single-phase high voltage shunt reactor.
Figure 2:
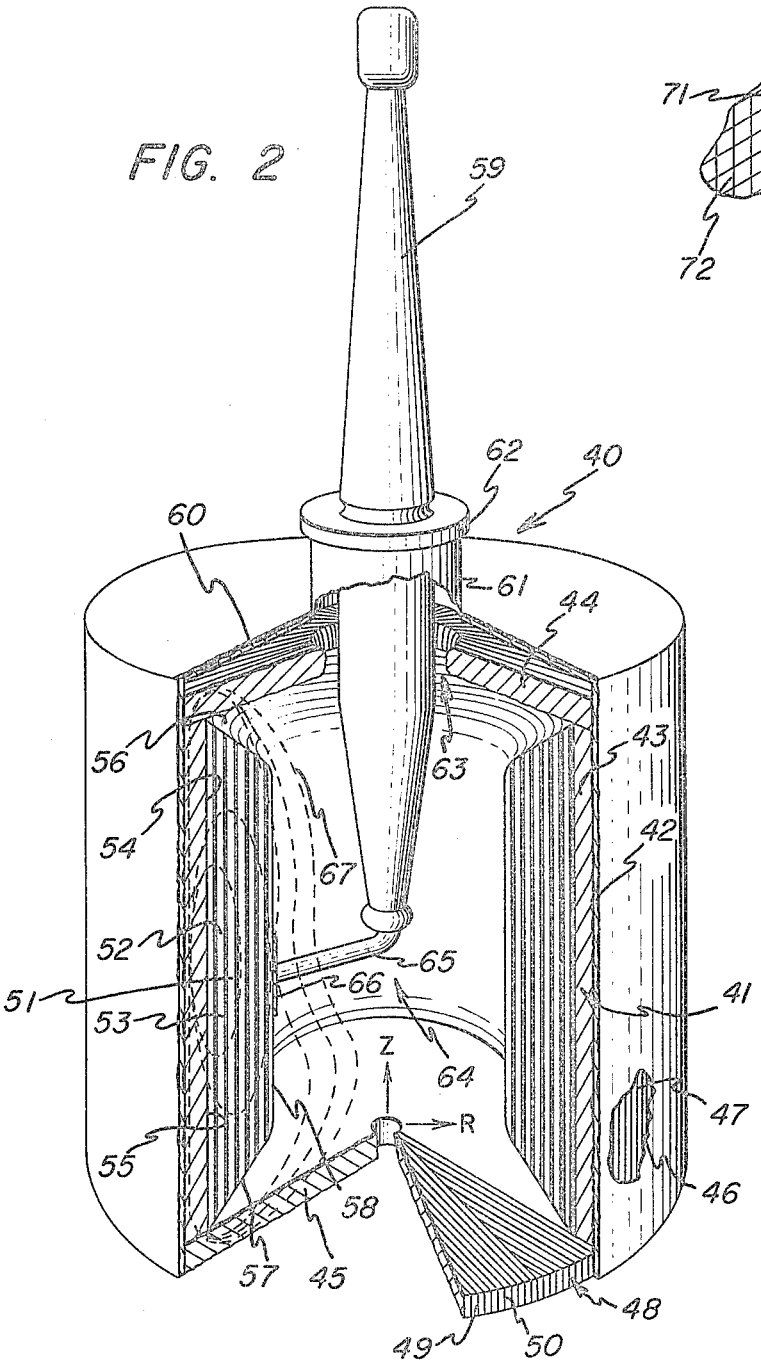
FIG. 2 is a schematic pictorial view with portions broken away of a shunt reactor built according to the instant invention.
Figure 3:
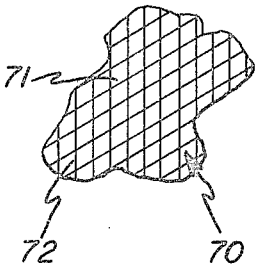
FIG. 3 is a schematic partial cross-sectional view of an alternative type of coil winding.

The specific features of the instant invention described herein and shown in FIGS. 1–3 are merely exemplary, and the scope of the invention is defined in the appended claims. Throughout the description and FIGS. 1–3, like reference characters refer to like elements of the invention.

FIG. 1 illustrates a conventional single-phase high voltage shunt reactor. The reactor 10 comprises a housing 11, in which a magnetic yoke 12 is disposed with a clearance between the yoke 12 and housing 11. The magnetic yoke 12 comprises a plurality of laminations of magnetic material separated by layers of insulating material. The insulating material and laminations of magnetic material are bonded together to form magnetic yoke 12. In the center leg 14 of the magnetic yoke, reactance gaps 15 are disposed at regular intervals from top to bottom of center leg 14. The reactor coil 16 is wound about center leg 14 and may comprise a plurality of layers of wire coated with insulation. Insulation gaps 17, 18 separate the upper and lower ends of coil 16, respectively, from the upper and lower horizontal legs 19, 20 of the magnetic yoke 12. Insulating space 21 separates coil 16 from the vertical legs 22, 23 of yoke 12. A high voltage bushing 24 is attached to one wall 25 of housing 11, within a large bushing housing 26 and incorporates a cable 27 making contact with coil 16.

The purpose of a shunt reactor is to respond to an alternating voltage impressed across it by passing a reactive "lagging" current. The reactor's capacity, Q, to perform this function is (measured in volt-amperes)

$$Q=EI,$$

which is also a measure of the ability of the device to store magnetic energy. It is readily shown that $$Q=EI=2\omega U$$

where E=applied voltage, I=reactor current, U=stored energy in joules and $\omega$=angular frequency of the applied voltage. The stored energy, U, is given by $$U = \tfrac{1}{2}BH\,V_U = \frac{B^2}{2K\mu_o}\,V_U$$

where $V_U$=the volume of the reactance gap, of permeability K, B=the flux density in Teslas, $H=B/\mu o$, and $\mu_o=4\pi\times10^{-7}$ Henry/m, the permeability of a material, e.g., air, with K=1. Usually, the active reactance gap contains no magnetic material, and therefore K=1. High values of B, i.e., flux density in the reactance gaps, are desired in order to achieve high energy storage, and this usually necessitates the use of electrical steel over much of the magnetic path. On the other hand, B is limited by the properties of available electrical steel, and, to a lesser extent, by the necessity to keep losses below a certain limiting value.

In the prior art example shown in FIG. 1 employing the gapped core design, the actual energy storage volume, the total volume of reactance gaps 15, is a very small part of the total reactor volume. Within this volume the density of stored energy is very high, due to the values of B attainable, e.g., 1.3–1.7 Tesla, however, the small volume of the reactance gaps 15 limits total energy storage. The design shown in FIG. 1 requires that insulating space be provided between the coil and the magnetic yoke and between the coil and the surrounding vessel. Additional space must be required for the high voltage bushing 24 which further reduces the space utilization of the reactor installation.

My instant invention as shown in FIG. 2 provides an alternative approach to the construction of high voltage reactors. The reactor 40 includes a cylindrical magnetic steel shell 41 contained within a housing 42. The shell 41 comprises a cylindrical ring 43 and upper and lower end plates 44, 45. Ring 43 is made up of a plurality of circumferentially adjacent laminations 46 of magnetic steel typically 0.10–0.30 mm thick separated by layers of insulating material 47, which may be an oxide coating on the magnetic steel or a polymeric sheet between layers of magnetic steel, and secured within housing 42. The laminations 46 may be bonded (e.g., by adhesive such as an epoxy) together to form a complete bonded ring within housing 42 or may be mechanically clamped into arcuate sections secured within housing 42. Upper and lower end plates 44, 45 are each made up of a plurality of wedges 48, each of said wedges 48 being made up of circumferentially adjacent laminations 49 of magnetic material separated by insulating layers 50 which may be oxide coatings or polymeric sheets. The laminations are bonded to form wedges 48 which are secured within housing 42 to form generally circular end plates 44, 45. Wound within shell 41 is the reactor coil 51 comprising a plurality of turns 52 of sheet conductor (shown greatly enlarged) separated from adjacent sheets by layers 53 of insulating material and wrapped concentrically within cylindrical ring 43 of the magnetic shell 41. The outermost turn 54 of sheet conductor immediately adjacent the inner surfaces 55 of ring 43 has an axial length approximately equal to that of ring 43. As the coil 51 is wrapped, the width of the sheet conductor is reduced gradually to reduce the coil height as the winding proceeds radially inward to produce the conically shaped surfaces 56, 57 at the respective ends of the coil 51. This provides an increasing insulating space between the coil ends and the magnetic shell as the coil 51 progresses from low voltage at outer turn 54 to high voltage at inner turn 58. An alternative approach to providing the tapered insulating space would employ a uniform width sheet conductor with conically tapered shell end plates and housing. A similar shell and housing construction could be employed for a layer wound wire coil. A high voltage bushing 59 passes through one end 60 of housing 42 and is secured to end 60 by collar 61 and ring 62. Bushing 59 passes through opening 63 in end plate 44 of the magnetic shell 41 into the reactance volume 64 within winding 51 and makes contact with inner layer 58 of coil 51 via conductor 65 and contact 66. In an alternative embodiment as shown in FIG. 3, the reactor coil comprises a plurality of wraps 70 of conductive wire 71 coated with insulating material 72 to form a layer wound coil within the magnetic shell. In such an arrangement a high voltage shield of conductive material is disposed at the radially inner surface of the coil.

The reactance volume 64 within coil 51 is entirely nonmagnetic (i.e., an air core). Air core reactors must be designed so that the flux within the core produces a minimum of eddy currents wherever the flux impinges upon conducting material, since eddy currents can give rise to substantial power losses, and therefore to subsequent thermal problems. In the device shown in FIG. 2, the magnetic flux in the non-magnetic core 64 can be contained by the magnetic shell 43 which surrounds the air core 64 and coil 51. This will assure that magnetic flux densities will be negligible in the region external to the magnetic shell 43. This design also ensures that limited eddy current generation is produced since, except for the opening 63 for the high voltage current lead, the reactor core 64 and coil 51 are completely enclosed by magnetic shell 43, and the reactor as a whole has cylindrical symmetry, and therefore all flux lies in radial (R-Z) planes as shown in FIG. 2. There is no azimuthal component of the magnetic field, and it therefore follows that all magnetic flux as shown by dashed lines 67 meets the magnetic shell 43 parallel to the plane of the laminations 46 of the magnetic shell 43. Due to this construction, power losses due to the generation of eddy currents in the shell are kept very small. This construction also provides a large energy storage volume 64 facilitating large total energy storage although the flux density is lower than that in the reactance gaps 15 of FIG. 1. By using the reactor design described herein, a major portion of the volume of a shunt reactor contributes energy storage volume, making possible smaller and lighter weight devices than the conventional gapped iron core reactors of the same power rating.

Compressed gas-insulated, sheet wound coreless reactors employing my instant invention would usually be constructed to have characteristics as listed in Table 1.

TABLE 1

| | |
|---|---|
| Reactive power rating: | 5000 KVA–500,000 KVA (single phase) |
| System voltage: | 138 KV–1300 KV |
| Total losses (% of reactive power): | 0.1%–0.3% |
| Flux density at the center of the coil: | 0.3–0.8 Tesla |
| Inside diameter of coil: | 25–100 cm |
| Outside diameter of coil: | 40–150 cm |
| Sheet conductor thickness: | 0.002–0.01 cm |
| Turn insulation: | 0.0025–0.008 cm |
| Number of turns: | 1000–6000 |
| Height of coil: | 30–200 cm |
| Outside diameter of magnetic shell: | 40–200 cm |
| Height of housing: | 60–300 cm |

TABLE 1-continued

| | |
|---|---|
| Diameter of housing: | 50–260 cm |
| Total weight: | 700–60,000 Kgm |
| Thickness of magnetic laminae: | 0.10 mm–0.30 mm |

A specific example of a compressed gas-insulated, sheet wound coreless reactor is shown in Table 2.

TABLE 2

| | | |
|---|---|---|
| Reactive power rating: | 100,000 KVAR (single-phase) | |
| System voltage: | 765 KV | |
| Reactor Losses: | Winding | 233 KW |
| | Magnetic Shell | 7 KW |
| | Total | 240 KW |
| Magnetic Design | | |
| Flux density at center of coil: | 0.7 Tesla | |
| Flux density within magnetic shell: | 0.92 Tesla | |
| Maximum magnetic shell interior height: | 212 cm | |
| Inside diameter of magnetic shell: | 134 cm | |
| Outside diameter of magnetic shell: | 140 cm | |
| Coil Design | | |
| Inside diameter of coil: | 50 cm | |
| Outside diameter of coil: | 134 cm | |
| Conductor (aluminum sheet): | 199 cm × 0.0056 cm | |
| Insulation between turns: | 0.0015 cm polymeric insulation | |
| Number of turns: | 5205 | |
| Housing dimensions | 143 cm diameter × 220.5 cm height | |
| Weights | | |
| Magnetic shell: | 5000 Kgm | |
| Conductor: | 4155 Kgm | |
| Solid insulation: | 956 Kgm | |
| Housing: | 1680 Kgm | |
| Total: | 11,800 Kgm | |

Oil-insulated wire layer wound coreless reactors employing my instant invention would usually be constructed to have characteristics as listed in Table 3.

TABLE 3

| | |
|---|---|
| Reactive power rating: | 5000 KVA–500,000 KVA |
| System voltage: | 138 KV–1300 KV |
| Total losses (as a percentage of reactive power): | 0.1%–0.3% |
| Flux density at center of coil: | 0.3–0.8 Tesla |
| Inside diameter of coil: | 30–150 cm |
| Outside diameter of coil: | 60–250 cm |
| Height of winding: | 100–300 cm |
| Outside diameter of magnetic shell: | 80–300 cm |
| Height of housing: | 130–400 cm |
| Diameter of housing: | 90–330 cm |
| Total weight: | 500–140,000 Kgm |

A specific example of an oil-insulated wire layer wound coreless reactor employing my invention is shown in Table 4.

TABLE 4

| | |
|---|---|
| Reactive power rating: | 110,000 KVAR (single-phase) |
| System voltage: | 735 KV |
| Losses: | 300 KW |
| Inside diameter of coil: | 61 cm |
| Outside diameter of coil: | 168 cm |
| Height of winding: | 229 cm |
| Number of turns: | 3164 |
| Flux density at center of coil: | 0.451 Tesla |
| Dimensions of housing: | 190 cm diameter by 390 cm height |
| Weights | |

TABLE 4-continued

| | |
|---|---|
| Magnetic shell: | 10,680 kgm |
| Conductor (copper): | 8400 kgm |
| Housing and fittings: | 7600 Kgm |
| Oil and other insulation: | 6200 Kgm |
| Total: | 32,880 Kgm |

A conventional reactor as shown in FIG. 1 of the same rating would weigh 131,600 kgm and require a housing 531 cm long by 335 cm wide by 406 cm high.

I claim:

1. A high voltage shunt reactor comprising:

a cylindrical housing;

a magnetic shell comprising an annular ring and two generally circular end plates disposed within said housing; said annular ring comprising a plurality of radially extending, circumferentially adjacent laminations of magnetic material separated by layers of insulation and arranged in said annular ring within said housing; each of said end plates comprising a plurality of wedge-shaped members bonded together; and each of said wedge-shaped members comprising a plurality of laminations of magnetic material separated by layers of electrical insulation and bonded thereto to form said wedge-shaped members;

a coil of electrical conductor wound concentrically inside said shell and being hollow to form a non-magnetic core disposed concentrically inside said coil and constituting a reactance volume; and a high voltage bushing extending through one axial end of said housing and through one of said end plates and into said core; said bushing having a high voltage conductor passing therethrough and making electrical contact with the radially innermost layer of said winding.

2. The apparatus of claim 1 wherein said annular ring comprises a plurality of laminations of magnetic steel 0.10–0.30 mm thick separated by layers of an oxide coating, and each of said wedge-shaped members comprises a plurality of laminations of magnetic steel 0.10–0.30 mm thick separated by layers of an oxide coating.

3. The apparatus of claim 2 wherein said coil comprises a plurality of turns of sheet conductor 0.002–0.01 cm thick separated by layers of electrical insulation 0.0025–0.008 cm thick.

4. The apparatus of claim 3 wherein said reactor comprises a compressed gas-insulated, sheet wound reactor having a reactive power rating in the range of 5000–500,000 KVA.

5. The apparatus of claim 2 wherein said coil comprises a plurality of wires of electrical conductor coated by a layer of electrical insulation wound within said shell; and said reactance volume is filled with an insulating oil.

6. The apparatus of claim 5 wherein said reactor comprises an oil-insulated layer-wound reactor having a reactive power rating in the range of 5000–500,000 KVA.

7. The apparatus of claim 1 wherein said annular ring comprises a plurality of laminations of magnetic steel 0.10–0.30 mm thick separated by layers of polymeric electrical insulation, and each of said wedge-shaped members comprises a plurality of laminations of magnetic steel 0.10–0.30 mm thick separated by layers of polymeric electrical insulation.

8. The apparatus of claim 7 wherein said laminations of magnetic steel of said annular ring are bonded together by adhesive, and said laminations of each of said wedge-shaped members are bonded together by adhesive.

9. The apparatus of claim 2 wherein said laminations of magnetic steel of said annular ring are bonded together by adhesive, and said laminations of each of said wedge-shaped members are bonded together by adhesive.

10. The apparatus of claim 2 wherein said laminations of magnetic steel of said annular ring are clamped into arcuate sections and said arcuated sections are secured within said housing.

* * * * *